US006452077B1

(12) United States Patent
Chapman et al.

(10) Patent No.: US 6,452,077 B1
(45) Date of Patent: Sep. 17, 2002

(54) DISENGAGABLE STRING DAMPER FOR A MUSICAL INSTRUMENT

(76) Inventors: Emmett H. Chapman, 6011 Woodlake Ave., Woodland Hills, CA (US) 91367-3238; Ned Steinberger, 420 Hilltop Rd., Nobleboro, ME (US) 04555

( * ) Notice: Subject to any disclaimer, the term of this patent is extended or adjusted under 35 U.S.C. 154(b) by 0 days.

(21) Appl. No.: 09/502,401

(22) Filed: Feb. 10, 2000

Related U.S. Application Data

(60) Provisional application No. 60/119,767, filed on Feb. 11, 1999.

(51) Int. Cl.[7] ..... G10D 1/10

(52) U.S. Cl. ..... 84/273; 84/287; 84/288; 84/318

(58) Field of Search ..... 84/273, 287, 288, 84/318, 267

(56) References Cited

U.S. PATENT DOCUMENTS

| | | | | | |
|---|---|---|---|---|---|
| 577,930 | A | * | 3/1897 | Prince | 84/318 |
| 1,518,935 | A | * | 12/1924 | Kozelek | 84/297 R |
| 3,427,916 | A | * | 2/1969 | Fender | 84/267 |
| 3,956,962 | A | * | 5/1976 | Fields | 84/267 |
| 4,116,107 | A | * | 9/1978 | Rickard | 84/267 |
| 4,753,147 | A | * | 6/1988 | Berardi | 84/453 |
| 5,284,077 | A | * | 2/1994 | Ellis | 84/318 |

* cited by examiner

*Primary Examiner*—Shih-Yung Hsieh
(74) *Attorney, Agent, or Firm*—J. E. McTaggart

(57) ABSTRACT

An open-string damper for stringed musical instruments, especially those played with a string-tapping technique, utilizes an elongated rectangular metal shift bar mounted in a transverse channel running across the fretboard of the instrument, located between the first fret and the nut. The shift bar, fitted with a pad of damping material on its top side facing the underside of the strings, is mounted in a constrained manner extending to both sides of the fingerboard so that it can be grasped between a thumb and finger and shifted by the user between two stable locations: an engaged location wherein the damping material is urged upwardly against the strings and a disengaged location wherein the damping material is held away from the strings. In one concept, the shift bar is captivated in an inclined plane system that moves the shift bar against the strings in response to user-actuation of the shift bar along the inclined plane which can be configured in either the shift bar or in the transverse channel in the fretboard. In another concept the shift bar is spring loaded and configured with at least one recessed keyhole slot that in the disengaged position holds the shift bar away from the strings by engagement of slot portion of a keyhole opening with the head of a screw driven into the fretboard; to engage the damper the shift bar is moved to allow the screw head to enter the large opening of the keyhole, where the spring loading then presses the shift bar and its damping material upward against the strings. In either concept, the shift bar can be designed to be actuated by movement in a lateral, longitudinal or other direction.

17 Claims, 4 Drawing Sheets

DISENGAGABLE STRING DAMPER FOR A MUSICAL INSTRUMENT

Benefit is claimed under 35 U.S.C. § 119(e) of pending provisional application 60/119,767 filed Feb. 11, 1999.

FIELD OF THE INVENTION

The present invention relates to the field of stringed musical instruments of the lute family such as guitars and more particularly it relates to an open string damper that can be readily engaged so as to damp the open strings and disengaged so as to leave the open strings undamped, directed particularly to bass guitars and stringed instruments played by a fret-tapping technique.

BACKGROUND OF THE INVENTION

In playing a guitar with conventional techniques, i.e. plucking, strumming or picking with one hand while stopping strings at selected frets with the other hand to set the pitch. Some notes can be played with open strings. Any strings left open (not fret-stopped) may ring slightly even if not played, but usually the amplitude is negligibly small: at worst it could be easily controlled by the player.

However, open string ringing may become troublesome in some special instruments such as bass guitars and/or instruments designed to be played with unusual techniques such as tapping, e.g. the Chapman Stick (R), which is played with using an independent two-handed tapping technique with the player's arms approaching the neck of the instrument perpendicularly from opposite sides. The higher pickup sensitivity utilized on instruments designed for this tapping technique generally require greater attention to the effects of open string ringing, particularly if there are more strings, e.g. ten versus six.

Known systems of fixed damping have been applied to open strings, however these have failed to provide any way to conveniently disengage the damping. Such disengagement may be required for special types of stringed instruments, e.g. those intended for both regular and tapping playing techniques.

DISCUSSION OF RELATED KNOWN ART

In considering damping devices for stringed instruments it is important to make a distinction between muting devices directed to reducing loudness of all notes played, and dampers such as in the present invention where damping is directed only to open strings, and is typically applied between the nut and the first fret (or another one of the lower frets) consequently the damper has no effect on any notes played at fret position that is stopped by the player's finger.

Muting devices acting simultaneously on all strings are typically located next to the bridge; such devices have been utilized on both acoustic and hard body electric guitars to "lower the sound" i.e. the overall amplitude of string vibration. Particularly in acoustic guitars this is one of very the few ways available to lower the loudness and modify the tone. Typically such muting devices were provided with some form of rocker or lever arm by which they could be readily engaged and disengaged by a performing musician: examples are found in U.S. Pat. Nos. 3,134,288 to Webster, 3,260,148 to Fender, 3,406,603, and 3,971,287 to Ito.

U.S. Pat. No. 4,173,165 to Rhodes for a FIXEDLY MOUNTED MUTE FOR STRINGED INSTRUMENTS discloses a mute that attaches selectively by clamp means to the strings between the bridge and the string holder or tailpiece.

U.S. Pat. No. 5,284,077 for DOBRO CAPO includes a resilient damper retainer member for damping the strings between the string support member and the nut.

U.S. Pat. No. 4,753,147 to Berardi for a GUITAR MUTE utilizes a tubular body of elasticized terrycloth that surrounds and attaches to the neck of the guitar outside the strings plus a felt pad under the strings.

U.S. Pat. No. 5,811,704 for GUITAR PRACTICE DEVICE discloses a "dummy" guitar simulator practice device with sound damping material disposed between the strings and at least one of the two mounting blocks between which the strings are suspended.

U.S. Pat. No. 4,116,107 to Rickard for a STRINGED INSTRUMENT MUTE MECHANISM for electric string bass or other stringed instrument has a mute mechanism located near the instrument bridge having a base part and a rubber-faced carrier mounted on two pairs of pivoted link members so as to be movable in and out of engagement with the bottom side of the strings by a manually shiftable slide lever extending outwardly to one side of the strings for access by a performer playing the instrument Muting devices acting on individual strings, generally for controlling loudness of acoustic guitars, made adjustable but not readily engaged and disengaged, are exemplified in U.S. Pat. Nos. 3,956,962 to Fields and 3,427,916 for GUITAR AND ADJUSTABLE MUTE THEREFOR.

All of the foregoing references, intended for general use on guitars, are directed to muting applied to all notes played, including those played by fingered fret positions as well as those played on open strings.

In contradistinction the open string damper of the present invention, directed more particularly to bass guitars and stringed instruments played by fret-tapping technique, is located between the nut and the first fret (or another of the lower frets) where it provides disengagable damping, which when engaged, applies only to open strings. The damper has no effect on all notes played at fret-stopped positions, as in the tapping technique.

OBJECTS OF THE INVENTION

It is a primary object of the present invention to provide, for a stringed instrument, a string damper that acts only on open strings (not on notes played at fingered fret positions), and that can be readily transitioned by the user between a fully engaged condition and a fully disengaged condition for different modes of playing.

It is an object to provide an embodiment wherein transition between the engaged condition and the disengaged condition is accomplished by movement of the damper in a substantially longitudinal direction along the neck of the instrument.

It is an object to provide an embodiment wherein transition between the engaged condition and the disengaged condition is accomplished by movement of the damping device in a substantially transverse direction across the neck of the instrument.

It is an object to provide an embodiment wherein transition of the damper between two stable conditions, i.e. fully engaged and fully disengaged, is made to be binary, with no intent to provide intermediate degrees of damping effect.

It is an object to provide an embodiment wherein transition of the damper between two stable limit conditions, i.e. fully engaged and fully disengaged, is to some extent proportional and dependant on displacement of a control element.

SUMMARY OF THE INVENTION

The abovementioned objects have been accomplished by the present invention of a damper for stringed musical instruments which is mounted in a channel running across the fretboard side of the neck of the instrument, between the first fret and the nut. An elongated rectangular metal shift bar is provided with a pad of damping material on its top side, facing the underside of the strings, is mounted in a manner that it can be shifted by the user between two stable locations: an engaged location wherein the damping material is urged upwardly against the strings and a disengaged location wherein the damping material is held down away from the strings.

In a first concept the channel has a bottom plane parallel to the fretboard and the shift bar, configured as with one or two recessed keyhole slots, is retained by a screw traversing each keyhole slot and threaded into the neck, and is urged upwardly by one or more compression coil springs. In the disengaged condition, the shift bar is held away from the strings by the underside of the screwhead(s) engaging the narrow region of the keyhole slot(s), In the engaged condition the shift bar is located such that the screwhead is in the large passageway opening of the keyhole slot(s), thus allowing the spring(s) to move the shift bar upwardly until it presses the damping material against the strings. To disengage the damper, the shift bar is grasped between a thumb and finger and pressed down away from the strings and then shifted along the direction of the slot(s) and released, so that, as described above, the shift bar is once again held clear of the strings by the screwhead(s) engaging the narrow region of the keyhole slot(s).

In a second concept utilizing an inclined plane implementation, both the bottom side the shift bar the floor of the transverse neck channel are configured with ramps to form an inclined plane interface, and the shift bar is configured with a pair of through-slots traversed by screws engaging the fretboard such that the damper can be deployed in either an engaged location and a disengaged location and can be moved back and forth between these locations by the user moving it along the ramps in the direction of the slots. In one version of the inclined plane system the damper travels longitudinally along the direction of the strings and in another version it travels laterally (across the strings).

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
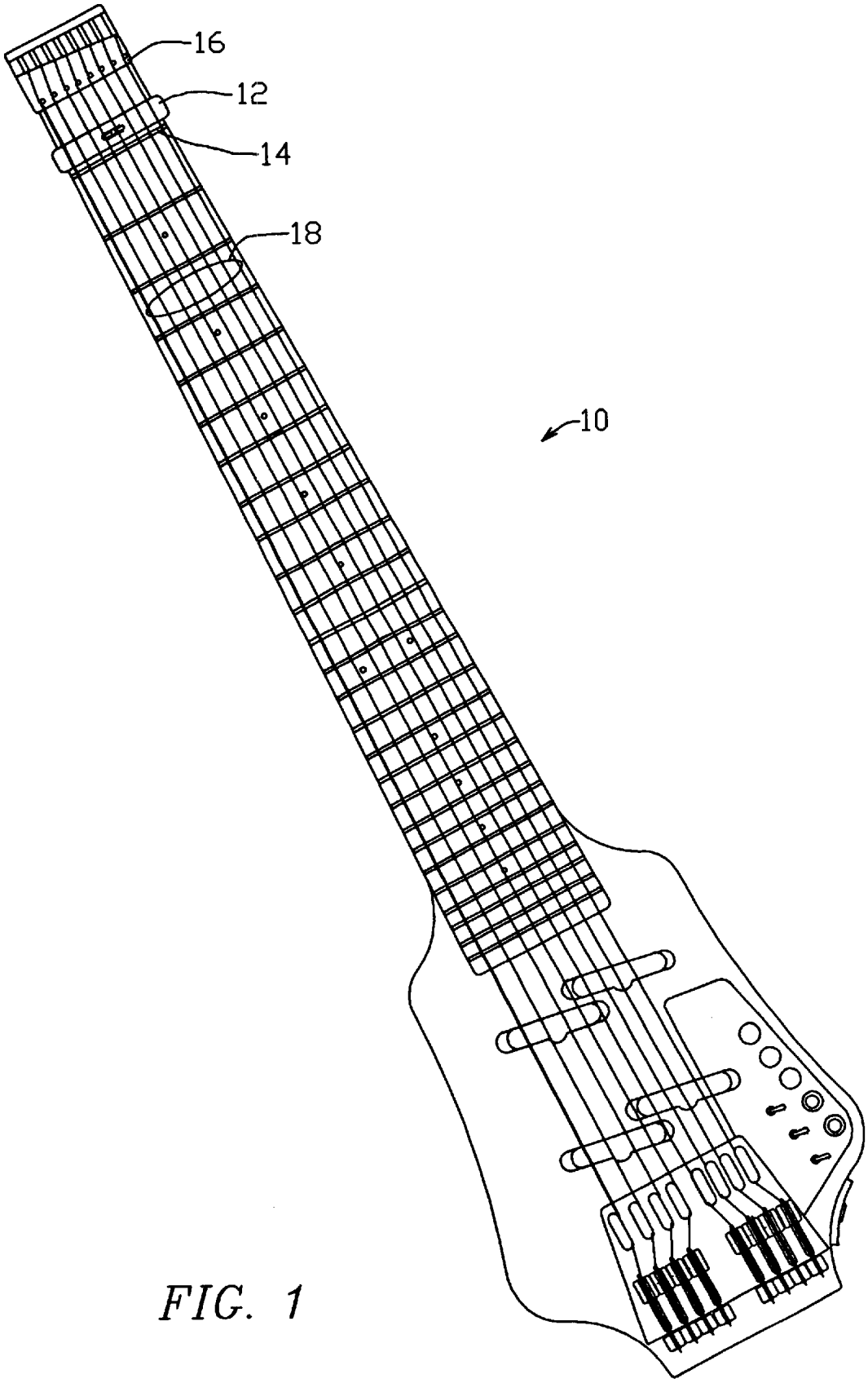
FIG. 1 is a front view of a stringed instrument fitted with a damper of the present invention.

FIG. 1 is a front view of an 8-string instrument 10 fitted with a damper 12 of the present invention, seen located adjacent the first fret 14 of the instrument 10, between fret 14 and nut 16 over which the strings 18 are stretched at the upper end.

Figure 2:
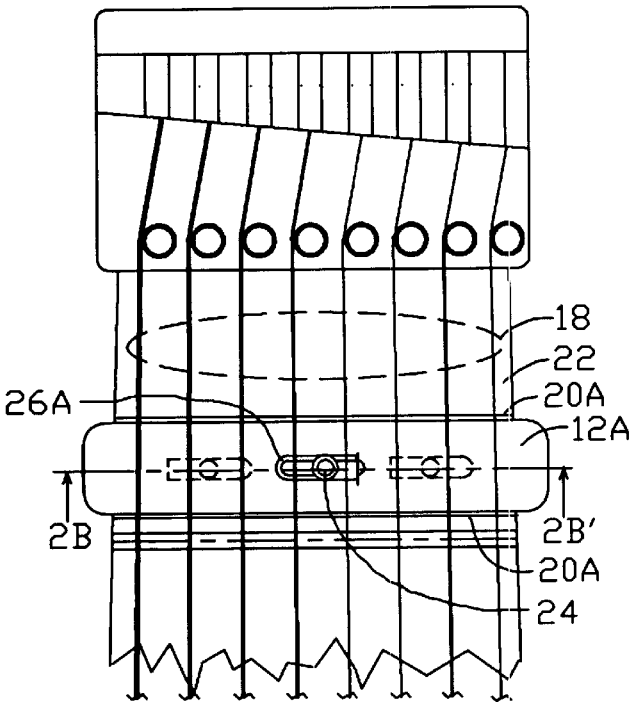
FIG. 2 is an enlargement of an upper end portion of FIG. 1 showing the damper of the present invention in a laterally-actuated ramp-type embodiment.

FIG. 2 is an enlargement of a portion of FIG. 1 at the upper end thereof showing a damperof the present invention in a laterally-actuated ramp-type embodiment having a shift bar 12A as the main element, fitted into a transverse channel 20A, configured across the fretboard region of neck 22 of the instrument such that the walls of channel 20A interface with the top and bottom edges of shift bar 12A as shown. At the center of shift bar 12A is seen a head of a screw 24 in a recessed slot 26A formed in shift bar 12A, oriented as shown to allow transverse movement of shift bar 12A in channel 20A. Slot 26A is configured with stepped sidewalls forming a ledge, as shown, that defines a wider upper slot portion facing the strings and a narrower lower slot portion facing the fretboard, so as to recess the head of screw 24, which engages the ledge in a sliding manner. Shift bar 12A is shown at a mid-setting of its travel range in recessed slot 26A, such that it extends equally beyond both sides of the neck 22. The surface of shift bar 12A facing the viewer is shown uncovered in this figure and in FIG. 1 for clarity; in completed form the damper includes a pad of damping material attached to this surface of shift bar 12A to act on the strings 18 for the desired damping action.

Figure 2A:
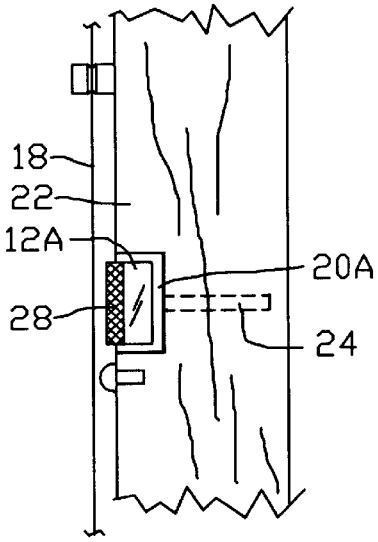
FIG. 2A is a side view of FIG. 2 showing an end view of the damper.

FIG. 2A is a side view of the subject matter of FIG. 2 showing an end view of the shift bar 12A located in channel 20A configured in the fretboard region of the neck 22 of a stringed instrument such as instrument 10 (FIG. 1). This view shows a layer of damping material 28, which can be made from a suitable resilient material, e.g. looped material of hook-and-loop Velcro type fastening material. Shift bar 12A is shown centered in its range of travel: in this condition the damping material 28 is located very close to strings 18 as shown.

Figure 2B:
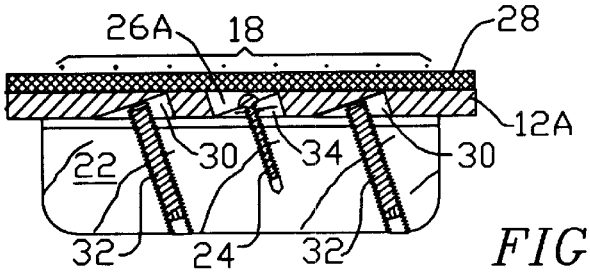
FIG. 2B is a cross-section through 2B–2B' of FIG. 2.

FIG. 2B is a cross-section through 2B–2B' of FIG. 2A, with the shift bar 12A shown centered in its range of travel as in FIG. 2A: again, in this condition the damping material 28 is located very close to strings 18 as shown. Shift bar 12A is supported on a pair of inclined slots 30 configured in its rear side, riding on the ends of a pair of set screws 32 threaded into angled holes in the neck 22, and is retained in place on the upper side by the head of screw 24 riding in an inclined slot 34 configured in the top side of shift bar 12A. Consequently shift bar 12A is constrained to travel only along the diagonal direction defined by the ramps of inclined slots 30 and 34; thus when the shift bar 12A is shifted to the right it moves upwardly toward strings 18 and when it is shifted to the left it moves downwardly away from strings 18.

Figure 2C:
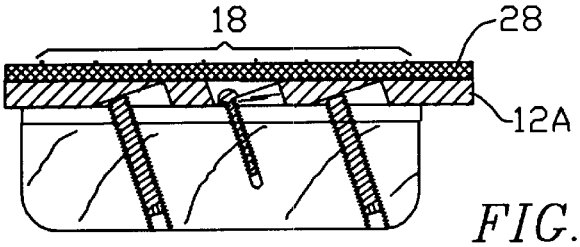
FIG. 2C is a cross section through 2B–2B' as in FIG. 2B but with the damper of the present invention in a longitudinally-actuated ramp-type embodiment.

FIG. 2C is a cross-section through 2B–2B' as in FIG. 2B but with the shift bar 12A shown shifted to the right for damper engagement; as described above in connection with FIG. 2B it moves upwardly, urging damper pad 28 upwardly against the strings 18, thus engaging the damping effect.

In a similar manner, when shift bar 12A is shifted toward the left for damper disengagement the damping pad 28 moves downwardly away from the strings 18, thus disengaging the damping effect and providing an undamped open string condition.

Figure 3:
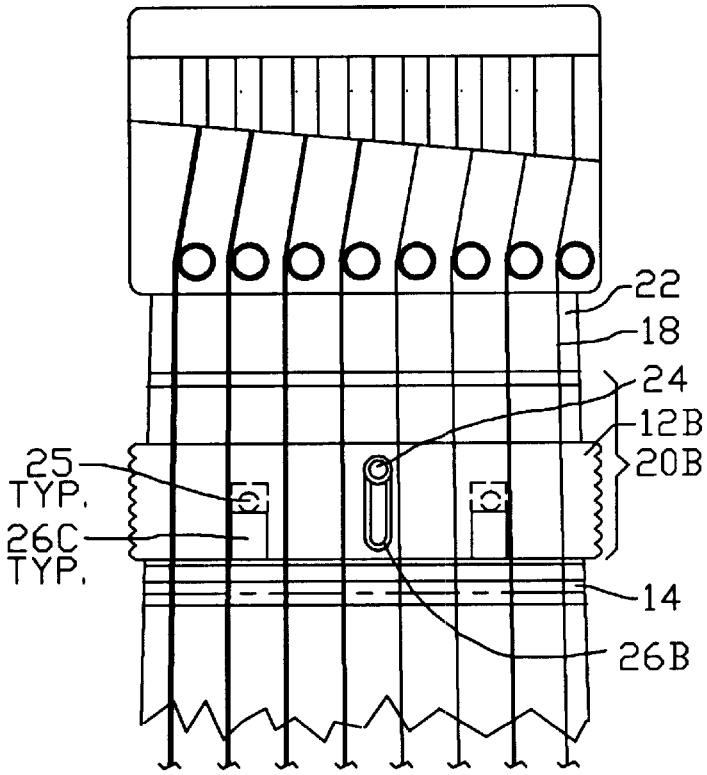
FIG. 3A is a side view of a main portion of FIG. 3 showing an end view of the damper set to the engaged condition.

FIG. 3 depicts an upper end portion of a stringed instrument such as the 8-string instrument 10 in FIG. 1, fitted with a shift bar 12B of the present invention in a longitudinally-actuated ramp-type embodiment wherein shift bar 12B is retained under the head of screw 24 in slot 26B which is oriented as shown to allow shift bar 12B to travel longitudinally, i.e. along the direction of neck 22. Shift bar 12B is shown at the lower end of its travel range where channel 20B is seen to extend above shift bar 12B by a travel distance that is set by the length of stepped slot 26B. As an optional refinement, a pair of guidepins 25 may be provided, firmly driven into neck 22 and arranged to cooperate with a pair of mating grooves 26C configured in shift bar 12B, as shown, so as to mate with guidepins 25 so as to constitute an end stop that constrains shift bar 12B in a desired location when it is moved to the engaged position in deployment of the damped open string mode.

Figure 3A:
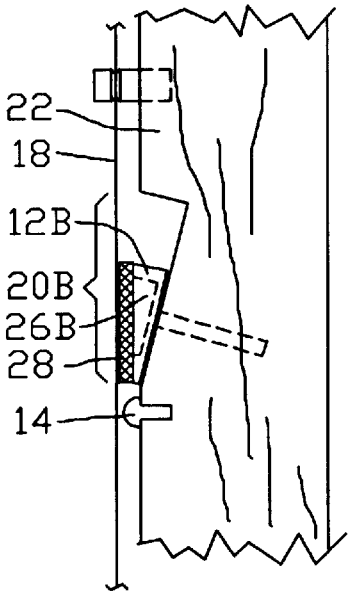

In FIG. 3A, the side view of a main portion of FIG. 3, channel 20B and shift bar 12B are seen to be each configured with a wedge-shaped cross-section having an inclined surface and a horizontal surface such that the two inclined surfaces on an interface inclined plane. Thus, in the same general manner as in FIGS. 2–2C but in the longitudinal direction in this case, shifting of shift bar 12B downwardly toward fret 14 will urge the damper pad 28 against the strings 18 to engage the damping effect and shifting it upwardly away from fret 14 will remove the damper pad 28 from the strings to disengage the damping effect.

The "ramped" embodiments of FIGS. 2–3A may be regarded as inherently proportional (or analog) in nature since they can be configured by the designer to provide a variable amount of string damping so that the player can set the shift bar to an intermediate setting within the working travel range that provides a partial damping effect, less than the full damping effect available.

Figure 4:
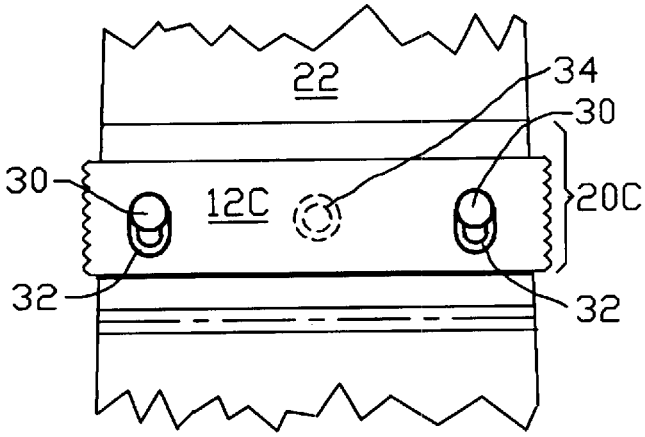
FIG. 4 depicts a portion near the upper end of a stringed instrument such as in FIG. 1 fitted with the damper of the present invention in a longitudinally-actuated dual-keyhole preferred embodiment.

FIG. 4 depicts a portion of neck 22, near the upper end of a stringed instrument such as in FIG. 1, fitted with the shift bar 12C of the present invention in a dual-keyhole embodiment that moves longitudinally (along the direction of the strings) in transverse channel 20C configured across neck 22. Channel 20C is configured with additional width as seen above shift bar 12C to allow it to travel in that direction along the neck 22. Shift bar 12C is constrained by the heads of a pair of screws 30, traversing keyhole slots 32 and threaded into neck 22, and is spring loaded by at least one coil spring 34, located as shown and constrained in a recessed cavity in the neck 22.

Figure 4B:
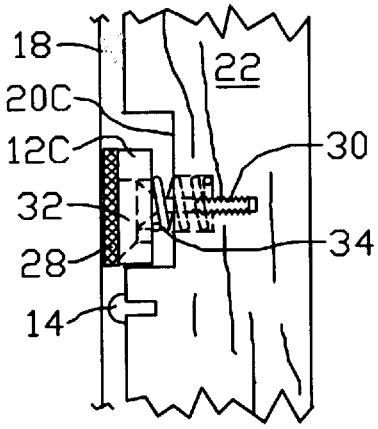
FIG. 4B is a side view of FIG. 4 showing an end view of the damper set to the engaged mode.
Figure 4A:
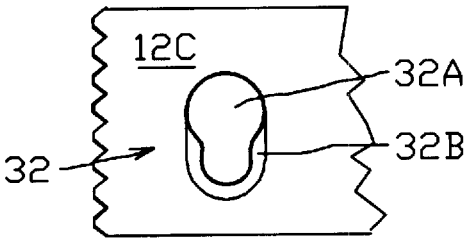
FIG. 4A is an enlarged view of the left hand end of the damper of FIG. 4 showing one of the recessed keyhole slots.

FIG. 4A is an enlarged view of the left hand end of shift bar 12C in FIG. 4, showing one of the two recessed keyhole slots 32 configured with a circular passageway 32A dimensioned to clear the head of the associated screwhead when the shift bar 12C is located at the lower end of its travel range in channel 20C as shown in FIG. 4. Keyhole slot 32 is also configured with a recessed shelf 32B that is dimensioned to allow entry of the threaded portion of screw 30, to provide bearing against the underside of the screwhead and to locate the screwhead recessed beneath the surface of shift bar 12C.

FIG. 4B, a side view from FIG. 4, shows an end view of the shift bar 12C with attached damper pad 28 urged toward the left against strings 18 by coil spring 34, retained in a recess in neck 22 as shown. In this engaged condition, at each end of shift bar 12C, the head of screw 30 is disposed in the circular passageway 32A of the keyhole slot 32, allowing the coil spring 34 to urge shift bar 12C with damper pad 28 against strings 18 and thus deploy the damping effect.

Referring to FIGS. 4, 4A and 4B: to disengage the damping effect, shift bar 12C, which is configured with serrated ends, is grasped by the user by the ends between a thumb and a finger, and in an L-shaped movement, shift bar 12C is moved first toward the fretboard so as to move damper pad 28 away from the strings, then moved away from the first fret 14 so as to locate the recessed shelf 32B of keyhole slot 32 under the head of screw 30, at each end of shift bar 12C. When released in this location, shift bar 12C will be set in the disengaged condition.

Figure 4C:
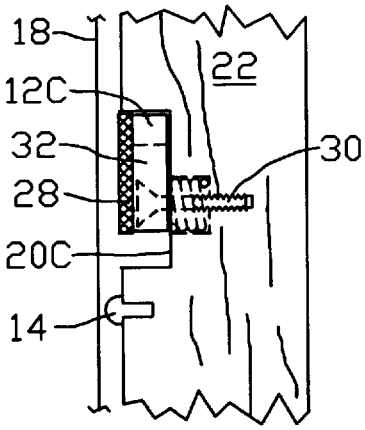
FIG. 4C is a side view of FIG. 4, but showing the damper set to the disengaged mode.

FIG. 4C shows shift bar 12C in the disengaged position in a side view from FIG. 4A. The end view of shift bar 12C shows it to have been pushed back away from strings 18 and upwardly, away from fret 14, to the limit of its travel as constrained by the upper wall of channel 20C. The head of screw 30, engaging the narrow portion of keyhole slot 32, holds shift bar 12C in the disengaged position with damping pad 28 separated from strings 18.

Figure 5:
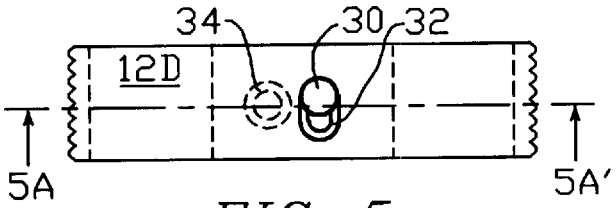
FIG. 5 depicts an alternative version of the damper of FIG. 4: a longitudinally-actuated single-keyhole embodiment set to the engaged mode.

FIG. 5 depicts a shift bar 12D which is a version of shift bar 12C of FIG. 4, both being longitudinally-actuated keyhole embodiments of the present invention, operating in the same manner; however, shift bar 12D, shown in the engaged position, is configured with only a single keyhole slot 32, retained by a single screw 30 and loaded beneath by a single coil spring 34, shown in hidden outline.

Figure 5A:
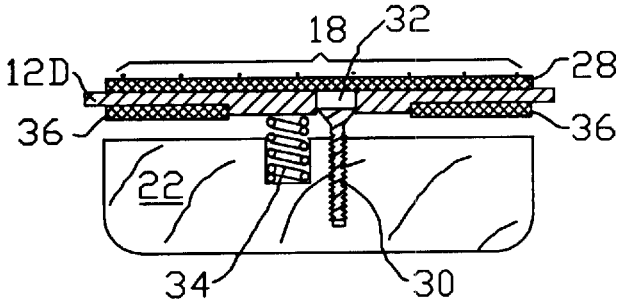
FIG. 5A is a central cross-section taken through 5A–5A' of FIG. 5 with damping material in place, set to the engaged mode.

FIG. 5A, a cross-section of shift bar 12D and a portion of neck 22 taken through 5A–5A' of FIG. 5, shows coil spring 34 located to the left of screw 30 and retained in a cylindrical cavity in neck 22. A pair of resilient pads 36, which may be of the same damping material as damper pad 28, are shown located under each end of shift bar 12D as shown. Pads 36 act as a buffer on the fretboard surface and prevent noise when the shift bar is being engaged or disengaged.

The "keyhole" embodiments of FIGS. 4–5A can implemented with any desired number of keyhole slots 32 and corresponding screws 30, and with any number of coil springs 34 as a design choice. Optionally a coil spring 34 could be located surrounding a corresponding screw 34, however the recessed opening would tend to weaken the anchoring of screw 30 in neck 22. A two-spring approach allows the damping force distribution between the left and the right string groups to be adjusted by making the two springs different in strength.

These "keyhole" embodiments (FIGS. 4–5A) may be regarded as inherently binary (or digital) in nature since they are normally intended to provide only the two fixed modes: damping fully engaged and damping fully disengaged.

While the above described embodiments show the travel direction of the shift bar for engagement and disengagement of string damping as being lateral or longitudinal, by design the shift bar could be made to travel in any desired direction for this purpose.

The invention may be embodied and practiced in other specific forms without departing from the spirit and essential characteristics thereof. The present embodiments are therefore to be considered in all respects as illustrative and not restrictive. The scope of the invention to be indicated by the appended claims rather than by the foregoing description; and all variations, substitutions and changes which come within the meaning and range of equivalency of the claims are therefore intended to be embraced therein.

What is claimed is:

1. A disengagable string damper for preventing vibration of and sound from unplayed open strings in a stringed musical instrument, particularly when the instrument is played in a string-tapping mode, the instrument having a set of tensioned strings disposed parallel to an upwardly-facing fretboard having a set of transverse frets and a string support nut that is disposed transversely at an end of the fretboard, supporting the strings at a predetermined separation above the fretboard, said string damper, being disengagable for playing the instrument in a conventional non-tapping mode, comprising:

a shift bar configured as a generally rectangular strip of hard material located between the strings and the fretboard and located between the nut and a predetermined one of the frets near the nut;

damping means for damping vibration of the strings, disposed on an upward-facing horizontal surface of said shift bar, facing the strings; and an actuation constraint system comprising (a) specifically-shaped retaining slot configured in the shift bar and (b) a retaining element affixed to the neck, made and arranged to interact with the retaining opening in a manner to constrain movement of said shift bar within a predetermined shift range in a predetermined direction relative to the fretboard, and to provide two user-selectable stable positions at opposite ends of the shift range: (1) a disengaged position wherein said damping means is held clear of said strings by the retaining element thus deploying an undamped open string condition for playing the instrument in the conventional non-tapping mode, and (2) an engaged position wherein said damping means is urged against said strings thus deploying a damped open string condition for playing the instrument in the string-tapping mode;

said shift bar being made to extend across the fretboard and arranged to enable a player of the instrument to select between the two playing modes by manipulating said shift bar in a manner to move it to either end position within the shift range.

2. The disengagable string damper as defined in claim 1 wherein said shift bar is located between a first fret and the nut.

3. The disengagable string damper as defined in claim 1 wherein said shift bar is made and arranged to enable a player of the instrument to select between the two playing modes by grasping the ends of said shift bar between a thumb and finger and moving it to either end position within the shift range.

4. The disengagable string damper as defined in claim 1 wherein:

the predetermined direction to which movement of the shift bar is constrained is made to be lateral relative to the shift bar and thus parallel with the strings;

said shift bar is configured to have a generally wedge-shaped lateral cross-sectional outline having an inclined bottom surface and a horizontal top surface;

said shift bar is configured with at least one elongate retaining slot, traversing vertically through a central region thereof, oriented laterally relative to said shift bar, and configured internally with stepped sidewalls forming a ledge defining a wider upper slot portion facing the strings and a narrower lower slot portion, the ledge being made parallel with the inclined bottom surface, said shift bar being made and arranged to enable a player of the instrument to select between the two playing modes by grasping the ends of said shift bar between a thumb and finger and moving it to either end position within the shift range; and the fretboard is configured with a transverse channel having a generally wedge shaped cross-section, similar to that of said shift bar, such that said shift bar can be contained in the channel with the horizontal upward facing surface of the shift bar substantially flush with the fretboard, thus locating said damping means in the disengaged position corresponding to the undamped open string mode wherein said damping means is held clear of the strings.

5. The disengagable string damper as defined in claim 4 wherein said actuation constraint mechanism further comprises:

at least one screw, having a head and a shaft, traversing through the corresponding retaining slot and engaging the fretboard, the upper slot portion being dimensioned to clear the screw head and the lower slot portion being dimensioned to closely clear the screw shaft, said screw being driven into the fretboard sufficiently to captivate said shift bar and constrain vertical movement thereof while allowing movement along the inclined plane within a shift range as determined by the inclined retaining slot, which is dimensioned so as to cause the shift bar to move upwardly along the inclined plane of the channel and thus press the damping means against the strings when the shift bar is moved to the engaged position in deploying the damped open string mode; and at least one guide pin firmly engaged in said fretboard, oriented substantially perpendicular to the inclined flat surface of the channel and located with a head end extending upwardly into the channel, said shift bar being further configured to provide for each guide pin a mating groove dimensioned and located to cooperate with said guide pin in a manner to provide an end stop when said shift bar is moved to the engaged position in deployment of the damped open string mode.

6. The disengagable string damper as defined in claim 5 wherein said actuation constraint mechanism comprises one said screw and two said guide pins flanking said screw.

7. The disengagable string damper as defined in claim 1 wherein said damping means comprises a pad of string damping material affixed to the upper surface of said shift bar.

8. A disengagable string damper for a musical instrument having a set of tensioned strings disposed parallel to an upwardly-facing fretboard having a set of transverse frets and a string support nut that is disposed transversely at an end of the fretboard, supporting the strings at a predetermined separation above the fretboard, said string damper comprising:

a shift bar configured as a generally rectangular strip of rigid material located between the strings and the fretboard and located between the nut and a predetermined one of the frets near the nut;

damping means for damping vibration of the strings, disposed on an upward-facing horizontal surface of said shift bar, facing the strings; and an actuation constraint mechanism made and arranged to constrain movement of said shift bar within a predetermined shift range in a predetermined direction relative to the fretboard, and to enable a user, by moving the shift bar within the shift range, to select between two stable positions at opposite ends of the shift range: (1) a disengaged position wherein said damping means is held clear of said strings thus deploying an undamped open string playing mode, and (2) an engaged position wherein said damping means is urged against said strings thus deploying a damped open string playing mode; said actuation constraint mechanism comprising:

a first inclined plane means made and arranged to engage said shift bar in a manner to lower and hold said damping means clear of the strings whenever said shift bar is moved to the disengaged position, and a second inclined plane means made and arranged to engage said shift bar in a manner to raise and hold said damping means against the strings whenever said shift bar is moved to the engaged position.

9. The disengagable string damper as defined in claim 8 wherein;

the predetermined direction to which the shift bar is constrained is longitudinal relative to the shift bar and thus perpendicular to the strings;

said shift bar is made substantially uniform in thickness and configured with an elongate retaining slot, traversing vertically through a central region thereof, oriented longitudinally relative to said shift bar and configured internally with stepped sidewalls forming a ledge defining a wider upper slot portion facing the strings and a narrower lower slot portion facing the fretboard; and said actuation constraint mechanism further comprises a screw, having a head and a shaft, traversing through the retaining slot and engaging the fretboard, the upper slot portion of said shift bar being dimensioned to clear the screw head and the lower slot portion being dimensioned to closely clear the screw shaft, said screw thus captivating said shift bar to the fretboard.

10. The disengagable string damper as defined in claim 9 wherein said first inclined plane means comprises:

the ledge being inclined so as to form an inclined plane extending from a lesser depth at a first end of the slot downwardly to a greater depth at the opposite end of the slot, said screw being oriented in an inclined direction substantially perpendicular to the inclined plane and driven into the fretboard sufficiently to constrain said shift bar against the fretboard with said damping means clear of the strings and thus deploy the open string undamped mode whenever said shift bar is moved to the disengaged position.

11. The disengagable string damper as defined in claim 9 wherein said second inclined plane means comprises:

said shift bar being further configured with a pair of like elongated cavities flanking the slot and co-linear therewith, each cavity facing the fretboard and having internally a flat ramp surface substantially parallel with the inclined plane of said first inclined plane system; and a pair of guide pins firmly engaged in said fretboard each disposed under a corresponding one of the elongated cavities and oriented substantially perpendicular to the ramp surface thereof, and each having a head end disposed so as to bear slidingly against the ramp surface of the corresponding cavity, so as to cause the shift bar to move away from the fretboard and press the damping means against the strings and thus deploy the open string damped mode whenever the shift bar is moved to the engaged position.

12. The disengagable string damper as defined in claim 8 wherein the fretboard is configured to have a transverse channel between the nut and the first fret, made and arranged to provide a recessed mounting base for said shift bar.

13. The disengagable string damper as defined in claim 1 wherein the fretboard is configured to have a transverse channel, located between the nut and a predetermined one of the frets near the nut; made and arranged to provide a recessed mounting base for said shift bar.

14. The disengagable string damper as defined in claim 1 further comprising a resilient biasing element associated with said actuation constraint system, made and arranged to urge said shift bar in an upward direction.

15. The disengagable string damper as defined in claim 1 wherein said resilient biasing element comprises at least one coil spring having an upper end bearing upwardly against said shift bar and a lower end bearing downwardly onto a recessed region of the neck of the instrument.

16. The disengagable string damper as defined in claim 1 wherein, in said actuation constraint system, said retaining element comprises a screw having a shaft portion, threaded into the neck, and an enlarged head portion.

17. A disengagable string damper for preventing vibration of and sound from unplayed open strings in a stringed musical instrument, particularly when the instrument is played in a damped-open-string tapping mode, the instrument having a set of tensioned strings disposed parallel to an upwardly-facing fretboard having a set of transverse frets and a string support nut that is disposed transversely at an end of the fretboard, supporting the strings at a predetermined separation above the fretboard, said string damper, being disengagable for playing the instrument in a conventional undamped-open-string non-tapping mode, comprising:

a shift bar configured as a generally rectangular strip of hard material of substantially uniform thickness located between the strings and the fretboard and located between the nut and a predetermined ore of the frets near the nut, damping means for damping vibration of the strings, disposed on an upward-facing horizontal surface of said shift bar, facing the strings;

an actuation constraint system comprising:

said shift bar being configured with at least one elongate retaining slot traversing vertically through said shift bar, a first end of the slot being configured internally with stepped walls forming a ledge defining a wider upper portion facing the strings and a narrower lower portion facing the fretboard, and a second end of the slot, opposite the first end, being configured with an enlarged opening through the shift bar, thus configuring a keyhole-shaped slot, a screw, having a head and a shaft, traversing through the retaining slot and engaging the fretboard perpendicularly, the enlarged opening being dimensioned to clear the head of the screw and the narrower lower portion of the retaining slot being dimensioned to clear only the shaft of the screw, and at least one coil spring disposed seated in a recess formed in the fretboard, and compressed to provide upward force against said shift bar;

the retaining slot, said screw and said coil spring being configured and arranged to co-operate in a manner such that in the disengaged position, said shift bar and said damping means are held away from the strings by the screw head vertically constraining the ledge in the corresponding end of the retaining slot thus keeping open strings undamped for playing the instrument in the conventional undamped-open-string non-tapping mode, then when said shift bar is moved to the engaged position, vertical constraint is lost due to the screw head clearance opening, allowing the spring to force the shift bar upwardly and press the damping means against the strings, thus damping the open strings for playing the instrument in the damped-open-string tapping mode.

* * * * *